US005141563A

United States Patent [19]

Colon et al.

[11] Patent Number: 5,141,563

[45] Date of Patent: Aug. 25, 1992

[54] MOLTEN SALT STRIPPING OF ELECTRODE COATINGS

[75] Inventors: Zoilo J. Colon, Chardon; Kenneth L. Hardee, Middlefield; Richard C. Carlson, Euclid, all of Ohio

[73] Assignee: ELTECH Systems Corporation, Boca Raton, Fla.

[21] Appl. No.: 452,861

[22] Filed: Dec. 19, 1989

[51] Int. Cl.[5] ..... B08B 3/10; B08B 3/12; B08B 3/14

[52] U.S. Cl. ..... 134/2; 134/3; 134/10; 134/28

[58] Field of Search ..... 134/1, 2, 3, 10, 28; 427/328

[56] References Cited

U.S. PATENT DOCUMENTS

| | | | |
|---|---|---|---|
| Re. 28,849 | 6/1976 | Itai et al. | 204/146 |
| 3,000,766 | 9/1961 | Wainer | 134/10 |
| 3,497,426 | 2/1970 | Okamura | 427/328 |
| 3,573,100 | 3/1971 | Beer | 134/3 |
| 3,684,543 | 8/1972 | de Nora et al. | 117/2 R |
| 3,684,577 | 8/1972 | Hitzel | 134/2 |
| 3,706,600 | 12/1972 | Pumphrey et al. | 134/2 |
| 3,761,312 | 9/1973 | Entwistle et al. | 134/3 |
| 3.761,313 | 9/1973 | Entwistle et al. | 134/3 |
| 3,837,879 | 9/1974 | Sluse et al. | 134/2 |
| 4,132,569 | 1/1979 | DePablo et al. | 134/3 |
| 4,446,245 | 5/1984 | Hinden | 427/126.5 |
| 4,568,430 | 2/1986 | Vire | 75/412 |
| 4,762,694 | 8/1988 | Maroni et al. | 75/400 |
| 4,818,303 | 4/1989 | Cole | 148/20 |

FOREIGN PATENT DOCUMENTS

| | | | |
|---|---|---|---|
| 1176600 | 10/1984 | Canada | 204/195 |

OTHER PUBLICATIONS

Hawley, G., *The Condensed Chemical Dictionary*, 9th Ed., ⅛1977, p. 901.

*Primary Examiner*—Olik Chaudhuri
*Assistant Examiner*—G. Fourson

[57] ABSTRACT

A method is now utilized for stripping costly electrocatalytic coatings from valve metal substrates while maintaining excellent integrity of the substrate metal. The removed metal may also be conveniently recovered. A molten salt bath of alkali metal hydroxide and alkali metal salt of an oxidizing agent is employed. Careful electrode to bath contact times and bath temperatures are observed. Additionally, a dilute mineral acid rinse and water rinse, with scrubbing in one of the rinses follows such molten salt bath contact for the electrode. Solids recovered from the rinses are combined.

8 Claims, 1 Drawing Sheet

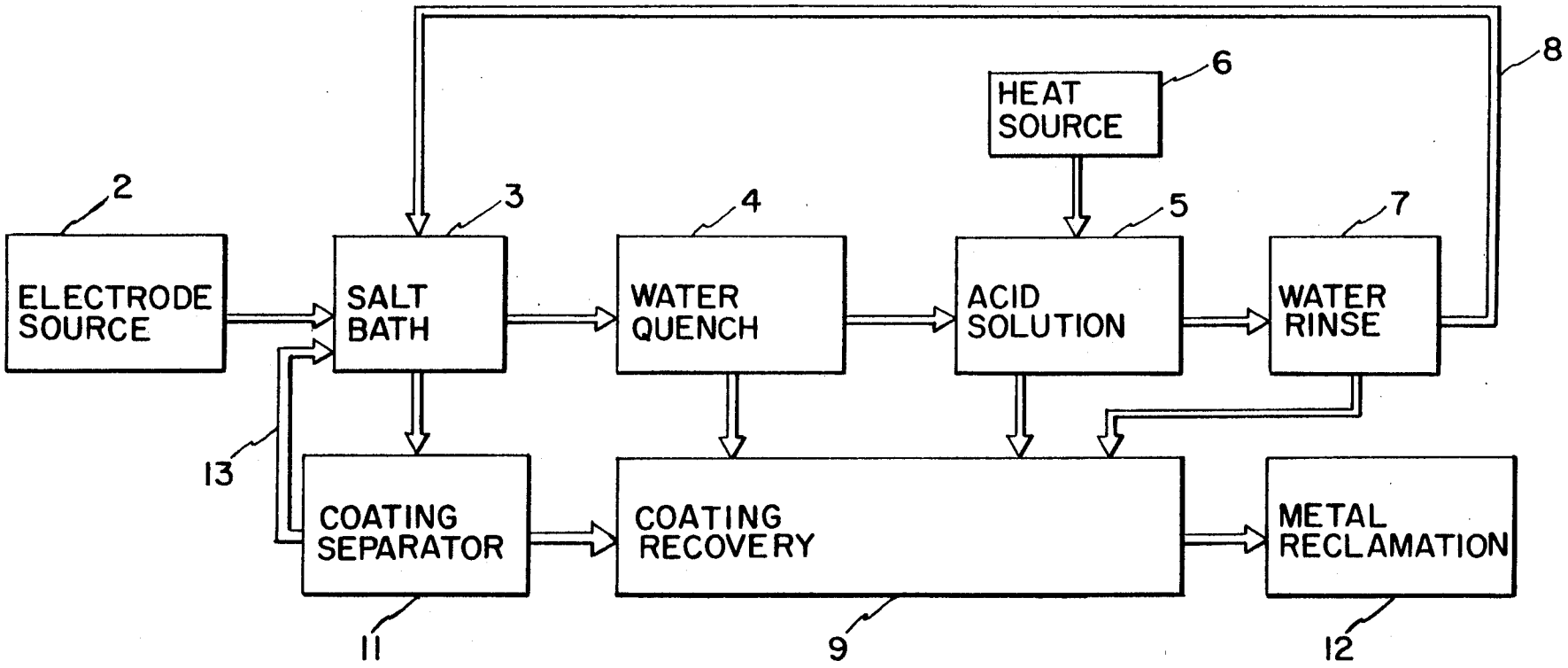
ELECTRODE SOURCE
2
SALT BATH
3
WATER QUENCH
4
ACID SOLUTION
5
HEAT SOURCE
6
WATER RINSE
7
8
COATING SEPARATOR
11
13
COATING RECOVERY
9
METAL RECLAMATION
12

MOLTEN SALT STRIPPING OF ELECTRODE COATINGS

BACKGROUND OF THE INVENTION

Soon after the development of electrodes having a metal base such as of titanium with an electrocatalytic coating such as of noble metals or their oxides, it was appreciated that coating removal would be desirable for recoating. Very early it was discovered that molten salt baths could be useful for this purpose.

Thus in U.S. Pat. No. 3,573,100 there is disclosed the method for cleaning electrodes using a melt containing an alkaline substance and an oxidizing salt. According to the patent teachings, successful coating removal can be achieved in only a few minutes with these molten salt baths typically heated at 450° C. to 500° C. Similarly, in U.S. Pat. No. 3,684,577 molten salt baths of an alkali metal hydroxide and an alkali metal salt of an oxidizing agent, where the hydroxide is equal to or predominant over the amount of the salt are taught to be useful for electrode coating removal. Again, fast removal times are disclosed.

It was however found that although stripping of the coating by molten salt baths could be accomplished, there could also be achieved a deleterious attack on the base metal. This could readily result in a base metal loss of as much as 5 weight percent. Additionally, recovery of the costly coating constituents from the molten salt bath was reported to be uneconomical.

Other approaches were therefore investigated after these early molten salt bath discoveries. One result was electrode recoating following mere cleaning without stripping of the old coating. Such technique has been disclosed for example in the U.S. Pat. No. 3,684,543. Another result, as discussed in Canadian Patent No. 1,176,600, was the formation of a non-adhesive, intermediate layer between the metal substrate and the electroconductive coating for facilitating subsequent coating removal.

These approaches also included employing solutions for coating removal that could be utilized at more moderate operating temperatures. For example in U.S. Pat. No. 3,761,312 there is taught a coating removal process using an acid or alkaline solution with hydrogen peroxide at a temperature of 60°-80° C. In the companion U.S. Pat. No. 3,761,313 the solution contains certain mineral acid plus hydrofluoric acid or precursor of such acid. Additionally, in U.S. Pat. Reissue No. 28,849 there is taught a method, using an inorganic electrolyte, for electrolytically removing the catalytic coating for the cleaning of the substrate metal.

There is still however a need for coating removal from such coated electrodes that achieves on the one hand preservation of the most desirable surface characteristics of the underlying substrate. On the other hand, the technique used should be able to handle complex electrode configurations, without preferentially attacking portions of the substrate, yet provide for efficient and economical recovery of valuable coating constituents.

SUMMARY OF THE INVENTION

There has now been achieved a method of removing electrocatalytic coating, especially electrocatalytic mixed oxide coatings, from an electrode substrate which technique offers the advantage of desirably retaining the best underlying metal substrate configuration, without deleterious harmful affect. The method is suitable for use with electrodes of complex shape. Efficient and economical recovery of valuable coating constituents is now achieved. The technique can be used for stripping removal of both new and used coatings without substrate damage, e.g., achieves desirable maintenance of substrate surface characteristics while achieving complete coating removal as determined by passivation testing.

In one aspect, the invention pertains to the broad process of removing electrocatalytic coating from a valve metal substrate electrode while recovering coating materials in said process, wherein coating removal includes contacting with a molten salt bath followed by subsequent electrode treatment. Within this broad process, this invention aspect is directed to the improvement in said process comprising contacting said electrode upon removal from said molten salt bath with mineral acid at a concentration range of 5 to 25 weight percent and at a temperature within the range of 25°-95° C.; removing said electrode from said acid; separating solids from said acid; contacting the resulting acid washed electrode with rinse water; removing said electrode from said rinse water; and separating solids from said rinse water.

In other aspects, the invention is directed to recovery of coating constituents directly from the molten salt bath, as well as directed to the use of scrubbing means at various stages of coating removal. In still further aspects, the invention is directed to a particularly serviceable molten salt bath as well as to recycling operation including conservation of salt bath ingredients.

BRIEF DESCRIPTION OF THE DRAWINGS

The FIGURE is a block diagram depicting one aspect for coating removal and coating material recovery according to the present invention.

DESCRIPTION OF THE PREFERRED EMBODIMENTS

The base metals of the electrode are broadly contemplated to be any coatable metal. For bearing an electrocatalytic coating, the substrate metals might be such as nickel or manganese, but will most always be valve metals, including titanium, tantalum, aluminum, zirconium and niobium. Of particular interest for its ruggedness, corrosion resistance and availability is titanium. As well as the normally available elemental metals themselves, the suitable metals of the substrate can include metal alloys and intermetallic mixtures.

As representative of the electrochemically active coatings that may be present on the substrate metal, are those provided from platinum or other platinum group metals or they can be represented by active oxide coatings such as platinum group metal oxides, magnetite, ferrite, cobalt spinel or mixed metal oxide coatings. Such coatings have typically been developed for use as anode coatings in the industrial electrochemical industry. They may be applied from water based or solvent based formulations, e.g., those using alcohol solvent. Suitable coatings of this type have been generally described in one or more of the U.S. Pat. Nos. 3,265,526, 3,632,498, 3711,385 and 4,528,084. The mixed metal oxide coatings can often include at least one oxide of a valve metal with an oxide of a platinum group metal including platinum, palladium, rhodium, iridium and ruthenium or mixtures of themselves and with other metals. Further coatings in addition to those enumerated above include manganese dioxide, lead dioxide, platinate coatings such as $M_xPt_3O_4$ where M is an alkali metal and X is typically targeted at approximately 0.5, nickel-nickel oxide and nickel plus lanthanide oxides.

The electrocatalytically-coated substrate metal, prior to coating removal, is advantageously a cleaned surface, e.g., cleaned of foreign materials including greases and oils. It is contemplated that this will be obtained most always by any of the usual chemical treatments used to achieve a clean surface, with mechanical cleaning being typically minimized. Thus the usual cleaning procedures of degreasing, either chemical or electrolytic, or other chemical cleaning operation may be used to advantage.

The salt baths which will be most always utilized herein are those which have been described in the prior art or are readily commercially available. Simplistically the bath can contain merely an alkali metal hydroxide plus an alkali metal salt of an oxidizing agent. Representative baths have been more particularly described in the U.S. Pat. No. 3,684,577. The teachings of this patent are incorporated herein by reference. As noted in such patent, the alkali-metal hydroxides can refer to the hydroxides of sodium, potassium and lithium or mixtures thereof and most notably sodium and potassium hydroxide. The alkali metal salt of an oxidizing agent can then refer to the sodium, potassium and lithium salts of such agents. These salts may be nitrates, chlorates, peroxides, permanganates and perchlorates.

Although the salt bath may be simply a mixture of an alkali-metal hydroxide plus an alkali-metal salt of an oxidizing agent, suitable salt baths may be more complex. For example, more than one hydroxide or oxidizing agent may be present. This can be the case with commercially available baths, which may contain both potassium and sodium hydroxide. Such baths may also contain an oxidizing agent plus additional agents, e.g., carbonates or halide salts. By way of illustration, the commercially available ALKO bath of Kolene Corporation contains not only potassium and sodium hydroxides, but also potassium nitrate and potassium carbonate. Their DGS (trademark) bath contains the two hydroxides plus sodium and potassium carbonate as well as sodium nitrate and sodium chloride. For purposes of the present invention where a more simplistic, usually more aggressive, bath is desired, such is advantageously simply a mixture of an alkali metal hydroxide plus an alkali metal salt of an oxidizing agent, and preferably potassium hydroxide plus potassium nitrate. Where a more complex, and usually less aggressive, bath is desired, the ALKO bath is preferred.

The temperature at which the molten salt bath is maintained, as well as the contact time between the electrode for coating removal and the molten salt bath, may be dictated by the make-up of the bath. The preferred, simplistic bath of potassium hydroxide and potassium nitrate is maintained at a bath temperature within the range of from 300° C. to about 450° C. Contrasted with this, the DGS bath referred to hereinbefore, is recommended to be held at a temperature within the range of 750° F. (434° C.) to 950° F. (546° C.). Even for the preferred simplistic bath, contact time between bath and electrode will be at least 5, but more typically for 15 minutes for desirable coating removal, but for economy will not exceed a time of 1 hour. Preferably, for economy plus desirable coating removal, the contact time with such simplistic bath will be on the order of 15–40 minutes. On the other hand, where a less aggressive bath such as the ALKO bath is used, contact times between electrode and bath on the order of 10 minutes to more than an hour, e.g., 1¼ hours, will be generally utilized. It is contemplated, that contact between bath and electrode will at least virtually always be by immersion of the electrode into the bath while the bath is in molten condition.

Referring now to the particular aspect of the invention as depicted in the Figure, an electrode (not shown) feeding from an electrode source 2 is introduced into a salt bath 3 having a composition such as described hereinabove. The electrode is maintained in the salt bath 3, and the salt bath 3 is maintained at a temperature, all as described hereinbefore. From the salt bath 3, the electrode can be moved to a water quench 4. The water quench 4 will be useful not only for cooling the electrode and providing a thermal shock that can remove particulates of coating that have been loosened in the salt bath 3, but also for removal by dissolution of any fused salt that is present on the electrode, thereby "neutralizing" the electrode surface. Usually the electrode will be maintained in the water quench 4 for only a short period, e.g., from only about 1 or 2 minutes up to 15 minutes. Such a short time will most always be sufficient for electrode cooling as well as salt dissolution. Although the water quench 4 will generally be just a tank containing water into which the electrode is immersed, it is also contemplated that the water quench 4 may be achieved by spray application, or by a combination such as a spray and dip technique. Spray or combination application can serve to reduce the contact time of the electrode at the water quench 4. The water temperature can also be dependent upon the type of water quench 4. Thus where a tank of water is used, the water in the tank may become quite warm, e.g., approach 150° F., but more typically will be a temperature within the range of from about 60° F. to about 120° F., while on the other hand, with spray application the water may be maintained at essentially a constant tap water temperature. It is to be understood that although it is contemplated to use chilled water which can enhance thermal shock, expedient water replacement can also provide such enhancement while leading to increased salt dissolution.

After removal from the salt bath 3, the electrode may contain anywhere from effectively no residual coating, such as determined by passivation testing of the electrode substrate, up to essentially all, or all, of the coating. For example, where an electrode is being cycled through the salt bath 3 for other than a first time, it can be expected that only residual coating will be retained on the electrode. Also, especially where an aggressive bath is utilized, some to all of the coating can be expected to be retained in the salt bath 3. Where an electrode is being processed through the salt bath 3 for an initial time, and particularly in the case where the bath is not aggressive, then much to all of the coating will be retained on the electrode. In the water quench 4 it can be expected that much of the coating will be loosened and spalled off. Even where only residual coating is on the electrode, usually some of this coating will be removed in the water quench 4.

From the water quench 4, the electrode can then be processed to the acid solution 5. The acid solution 5 is maintained at elevated temperature by means of a heat source 6. The useful acids for the acid solution 5 include hydrochloric acid, sulfuric acid, and phosphoric acid, as well as mixtures of acids, e.g., a mixture of hydrochloric and nitric acid. These will usually be dilute acid solutions, e.g., a solution of 20 volume percent of sulfuric acid. Normally the acid used will have a strength within the range of from about 5 to 25 weight percent.

The duration of contact between the acid solution 5 and the electrode will usually not be lengthy, such as on the order of no longer than 60 minutes. A contact time of from only 1 or 2 minutes, but more typically 5 minutes, up to about 10–15 minutes will be most typical. As with the water quench 4, the acid solution 5 will most typically be merely a tank containing an acid bath, i.e., a solution of acid in water, into which the electrode is immersed. It is however also contemplated that the acid solution 5 may be spray applied or that combinations can be utilized, e.g., spray and dip application. In the acid solution 5 it can be expected that there will be further removal of residual coating. Such removal is enhanced by employing a heated acid solution 5, although generally the acid solution will be at a temperature within the range of from 25° C. to 95° C. Heat may be supplied in any of the ways conveniently useful for providing heat to an aqueous solution, e.g., by feeding steam from the heat source 6 into a tank of the acid solution 5. For efficient removal of coating residue, the acid solution 5 will be maintained at a temperature of at least about 130° F. For economy, such solution is maintained below boiling condition. Advantageously, for best economy, plus efficiency of residual coating removal, the acid will be at a temperature within the range of from about 120° F.–180° F.

After removal from the acid solution 5, the electrode then proceeds to the water rinse 7. As with the water quench 4, the water rinse 7 provides for removal of the previous processing residues, i.e., acid solution. Thus in this sense, the electrode can be expected to be again "neutralized" in the water rinse 7, i.e., take on the pH of the rinse water. As with the water quench 4, the water rinse 7 may be simply a tank holding a bath of water maintained at a temperature as discussed hereinbefore for a water quench bath. Or the rinse can utilize other application means, e.g., spray application or spray and dip combined. The electrode is usually present in the water rinse 7 for a short period of time sufficient for removing residual acid, e.g., for a time of on the order of 1–2 minutes and usually not exceeding 30 minutes. Regardless of application technique, it is contemplated that the water for the water rinse will be at temperature as described hereinbefore, although heated or chilled water would be serviceable. After removal from the water rinse 7, the electrode typically proceeds by electrode recycle 8 back to the salt bath 3. It will not be unusual for the water rinse 7 to contain some residual coating. Also, an electrode might proceed through the system from salt bath 3 through water rinse 7 for as many as 1 to 20 cycles. Such recycling can be dependent upon such factors as fresh or old coating needed for removal, type of coating, amount of coating, surface geometry of the substrate, salt bath make-up and temperature as well as initial contact time for the electrode in the salt bath 3.

It is contemplated that in any of the above-described post salt bath operations, i.e., the water quench 4, acid solution 5, or water rinse 7, the electrode can come into contact with scrubbing means. Such contact will enhance removal of residual coating. Where a post salt bath step employs a bath of liquid, scrubbing means might be supplied by ultrasound or mechanical brush or high pressure spray. Where spray application is employed, such scrubbing means can be pulsed spray or a combination spray and brush technique. Moreover, it is contemplated to use ultrasound in the molten salt bath for coating removal.

Effluent from the post salt bath stages is fed to coating recovery means 9. The coating recovery means 9 will typically be any process useful for separating solids from an aqueous liquid. Typically there will be used in these means 9, a system such as decantation, centrifuging, filtration or a combination of such techniques.

Particularly where more aggressive salt baths are employed, coating constituent removal from the molten salt will be most useful. This may be accomplished by feeding the molten salt to a coating separator 11 and initiating a technique such as precipitation or filtration of the molten salt in the separator 11 to prepare a coating-solids-containing, molten salt bath sludge. For example, the molten salt bath 3 may be filtered through a metallic or ceramic filter media. Where the overall coating removal system also has coating recovery means 9, the molten salt bath salt sludge obtained from the separator 11 can be fed into the coating recovery means 9. After such separation, the salt bath depleted of coating constituents, may be recycled from the separator 11 to the salt bath 3 in salt bath recycle line 13.

It is to be understood that variations of the system from the particular aspect of the invention depicted in the Figure may be utilized. For example, the water quench 4 might be eliminated whereby the electrode can proceed directly from the salt bath 3 to the acid solution 5. Also, if coating residues from the water rinse 7 are minimal, liquid from the water rinse 7 may not be fed to the recovery stage 9, or the water rinse 7 might be eliminated, with the electrode proceeding back to the water quench 4, then to the salt bath 3. For the water quench 4, as well as the water rinse 7, it is preferred to use deionized water, as tap water may contribute ions which can deleteriously interfere with the recovery of valuable metal coating constituents. The water of the water quench 4 and water rinse 7 may come from the same source and may contain additives such as foaming agents or fine-particle coagulating agents.

From the separator 11, or from the coating recovery means 9, or from both, coating constituents will be fed to metal reclamation means 12 for further reclamation particularly of valuable individual metal constituents of the coating, e.g., the metals such as iridium, rhodium, or ruthenium and the like as have been mentioned hereinbefore.

The following examples show ways in which the invention has been practiced but should not be construed as limiting the invention.

EXAMPLE 1

A bath was prepared for first blending together 5 weight parts of potassium hydroxide with 1 weight part of potassium nitrate and heating the resulting mixture to a temperature of 350–450° C. The bath was utilized with titanium plates bearing an electrically conductive coating thereon of tantalum oxide/iridium oxide. These electrocatalytically coated titanium plate electrodes were immersed individually in the molten salt bath each for a time of 30 minutes. Each electrode was then carefully removed, permitted to drain above the bath so that virtually all visible molten salt drains from the electrode, which was then immediately immersed in acid solution containing 18 weight percent hydrochloric acid in water at room temperature. Following immersion of each titanium plate electrode in the acid solution for one minute each plate was removed and rinsed with running deionized water.

Upon visual observation, each titanium plate is observed to be thoroughly cleaned of coating, providing the appearance of polished, silvery fresh metal. Upon cooling of the bath, analysis by inductively coupled plasma indicated that about 83 weight percent of the original coating of iridium metal was accounted for in the molten salt bath.

EXAMPLE 2

A titanium plate electrode with an electrocatalytically active coating of tantalum and iridium oxides was immersed in the hereinbefore described ALKO bath of Kolene Corporation. This salt bath 3 was maintained at 218° C. and had a specific gravity at 20° C. of two and a boiling point at 760 mm. Hg of 1288°. The electrode was immersed for 30 minutes in this salt bath 3 then placed in the water quench 4 for two minutes followed by 10 minutes in 25 weight % sulfuric acid solution 5 maintained at 85°-90° C. From the acid solution 5, the electrode was passed to a two minute water rinse 7. This entire cycle from salt bath 3 through water rinse was repeated three more times with the exception that the subsequent cycle time for immersion in the molten salt bath 3 was 60 minutes.

The coating was completely removed as evidenced by attempting to operate the titanium plate as an anode in sulfuric acid. The titanium plate immediately reached 20 volts indicative of passivation which would not occur with the presence of the electrocatalytically active coating. The surface roughness was maintained as determined by profilometer measurement which indicated a surface roughness (Ra) of 652 microinches before stripping and 609 microinches after stripping. Profilometer measurement used a Hommel model T1000 C instrument manufactured by Hommelwerk GmbH.

What is claimed is:

1. In the process of removing electrocatalytic coating from a valve metal substrate electrode while recovering coating solids in said process, wherein coating solids removal includes contacting said electrode with a molten salt bath followed by subsequent electrode treatment, the improvement in said process comprising:

(a) contacting said electrode upon removal from said molten salt bath with mineral acid in aqueous solution at a concentration range of 5 to 25 weight percent and at a temperature within the range of 25°-95° C. for a time of at least about 5 minutes but not exceeding about 60 minutes;
(b) removing said electrode from said acid;
(c) separating solids from said acid;
(d) contacting the resulting acid washed electrode with rinse water;
(e) removing said electrode from said rinse water;
(f) scrubbing said electrode in one or more of said mineral acid or said rinse water;
(g) separating solids from said rinse water; and
(h) combining solids separated from said acid with solids separated from said rinse water.

2. The process of claim 1, wherein said electrode is contacted with a mineral acid selected from the group consisting of hydrochloric acid, sulfuric acid, phosphoric acid, mixtures thereof and mixtures thereof in combination with other mineral acids.

3. The process of claim 1, wherein said process also comprises:

(g) separating solids from said molten salt bath, and
(h) combining separated solids from the steps (c), (f) and (g).

4. The process of claim 1, wherein said solids separated from said acid combined with solids separated from said rinse water are combined with the molten salt bath salt sludge, and the combined solids are processed for reclamation.

5. The process of claim 1, wherein said electrode upon removal from said salt bath is water quenched and then contacted with the mineral acid, and the resulting solids are separated from the quench water.

6. The process of claim 5, wherein said solids separated from the quench water are combined with solids separated from one or more of said mineral acid, said rinse water, or said molten salt bath sludge.

7. The process of claim 1, wherein said scrubbing is mechanical or ultrasonic.

8. The process of claim 5 wherein said quench water and said rinse water are maintained at a temperature within the range of 60° F. to about 120° F.

* * * * *